United States Patent [19]

Curran

[11] 4,120,276

[45] Oct. 17, 1978

[54] GUN WITH INTERMEDIATE SUPPORT FOR BARREL THEREOF

[75] Inventor: Roger Curran, Stratford, Conn.

[73] Assignee: Bangor Punta Operations, Inc., Greenwich, Conn.

[21] Appl. No.: 765,554

[22] Filed: Feb. 4, 1977

[51] Int. Cl.[2] ..... F41F 17/06; F41B 11/06

[52] U.S. Cl. ..... 124/85; 42/75 B

[58] Field of Search ..... 124/66, 67, 68, 69, 124/70, 73, 74, 75, 76, 77, 83, 85; 42/75 A, 75 B, 76 R

[56] References Cited

U.S. PATENT DOCUMENTS

| | | | |
|---|---|---|---|
| 651,634 | 6/1900 | Markham | 124/67 |
| 688,462 | 12/1901 | Fidjeland | 42/75 B X |
| 2,301,653 | 11/1942 | Wells | 124/73 |
| 2,312,150 | 2/1943 | Conner | 42/75 A |
| 3,766,903 | 10/1973 | Fischer | 124/67 |

*Primary Examiner*—Richard T. Stouffer
*Attorney, Agent, or Firm*—Patrick J. Walsh

[57] ABSTRACT

Disclosed is a gun barrel disposed within a barrel shroud. The rearmost ends of the shroud and barrel are supported in the gun frame and the opposite end portions of the shroud and barrel are interconnected and mutually supporting. A barrel support ring is disposed intermediate opposite ends of the barrel and includes an aperture for receiving the barrel and margins resiliently bearing against the inside surface of the shroud to provide a friction fit. The barrel ring supports the intermediate portion of the barrel within the shroud and prevents loss of straight-line dimension along the length of the barrel.

16 Claims, 8 Drawing Figures

GUN WITH INTERMEDIATE SUPPORT FOR BARREL THEREOF

The present invention relates to guns and more particularly relates to a support for a gun barrel.

In many types of guns, for example gas powered guns for firing BB shot, the barrel is disposed within a barrel shroud. The barrel shroud, among other functions, serves to protect the barrel from loss of its linear or straight-line dimension. Conventionally, the barrel is supported at its opposite ends. That is, the rearmost end of the barrel is normally supported by the gun frame. The barrel shroud is likewise supported at its rearmost end by the gun frame. The opposite ends of the barrel and shroud at the forward tip of the gun are interconnected one to the other and are mutually supportive. Between the portions of the frame supporting the barrel and the interconnection between the barrel and shroud at the tip of the gun, there is conventionally a void. That is, the barrel is conventionally unsupported intermediate its opposite ends.

Barrels for this type gun are made of thin wall hydraulic tubing which is very difficult to hold in a straight-line condition in manufacture or in subsequent handling. So when a bent barrel is assembled with a shroud member the barrel being unsupported intermediate its length, remains in bent condition. In the present gas-powered gun or BB gun, this can result in the application of a spin to the BB shot as it passes through the barrel. This is undesirable since the projectile or BB shot will follow a curvilinear path to the target. Also, when the barrel loses its straight-line or linear dimension, it remains difficult to hit targets even with an adjustment of the sights carried along the shroud.

The barrel shroud, being much larger in diameter than the barrel itself, is better able to resist bending stress and is more likely to retain a straight condition during manufacture and handling. The shroud is therefore capable of supporting the barrel in a straightened condition utilizing supporting means at each end of the barrel and an additional support element intermediate the barrel ends. There are a number of conditions occurring in shroud manufacture which impede satisfactory support of the barrel at the interior surface of the shroud. The shroud does vary considerably in inside diameter making it difficult to obtain a satisfactory friction fit for an intermediate barrel support element. A weld seam extending longitudinally of the shroud adds to the difficulty of a satisfactory friction fit. The barrel does not lie along the centerline of the shroud and, a support element must eccentricaily position the barrel. The interior surface of the shroud contains an oil film deposited during its manufacture, and a support element must maintain friction fit over the life of the gun in the presence of the oil film, and must not degrade by interaction with the oil film.

The present invention provides a support for a gun barrel which minimizes or eliminates the foregoing and other problems associated with prior gun barrel supports and provides a novel and improved support for a gun barrel having various advantages in construction, operation and use in comparison with such prior gun barrel supports. Particularly, the present invention provides a support for a gun barrel which prevents loss of the linear or straightline dimension of the barrel. To accomplish this, the present invention provides for a novel support element for disposition within the shroud intermediate the length of the barrel to maintain the straight-line or linear dimension of the barrel intermediate its end supports.

More particularly, the gun barrel of the present invention is supported at its rearmost end in the gun frame. A shroud surrounds the gun barrel in radially spaced relation therewith and has its rearmost end also supported in the gun frame. The opposite ends of the gun barrel and shroud are interconnected and mutually supported by an annular member which also forms the front sight and provides the front support for the magazine tube. Intermediate the ends of the barrel, a barrel support element or ring is received about the barrel and has margins engageable along the inside surface of the shroud. Preferably, the element is formed of a plastic material and the margins resiliently bear against the shroud to afford a friction fit with the shroud. The element also carries an aperture by which, with a suitable tool, the element can be centered within the shroud to properly locate the barrel in line with the barrel supports at opposite ends of the barrel. By locating the barrel support ring or element intermediate the length of the barrel, any tendency of the barrel to become misaligned or to lose a straight-line dimension or linearity is effectively prevented and a true straight bore is maintained.

A support element according to the present invention establishes a suitable friction fit with the shroud and elastically straightens any longitudinal bend occuring in the barrel. According to the invention the support element is readily inserted into the barrel shroud from one end while the barrel itself is inserted from the other end of the shroud without displacing the support element.

Accordingly, it is a primary object of the present invention to provide a novel and improved support for a gun barrel.

It is another object of the present invention to provide a novel and improved support for a gun barrel which ensures retention of the straight-line or linear dimension of the barrel throughout its serviceable life.

It is still another object of the present invention to provide a novel and improved support for a gun barrel which is easily applied to the barrel and within the gun barrel shroud.

It is a further object of the present invention to provide a novel and improved support for a gun barrel which is formed inexpensively and preferably of a molded plastic construction.

These and further objects and advantages of the present invention will become more apparent upon reference to the following specification, appended claims and drawings wherein:

Figures 1, 2, 4:
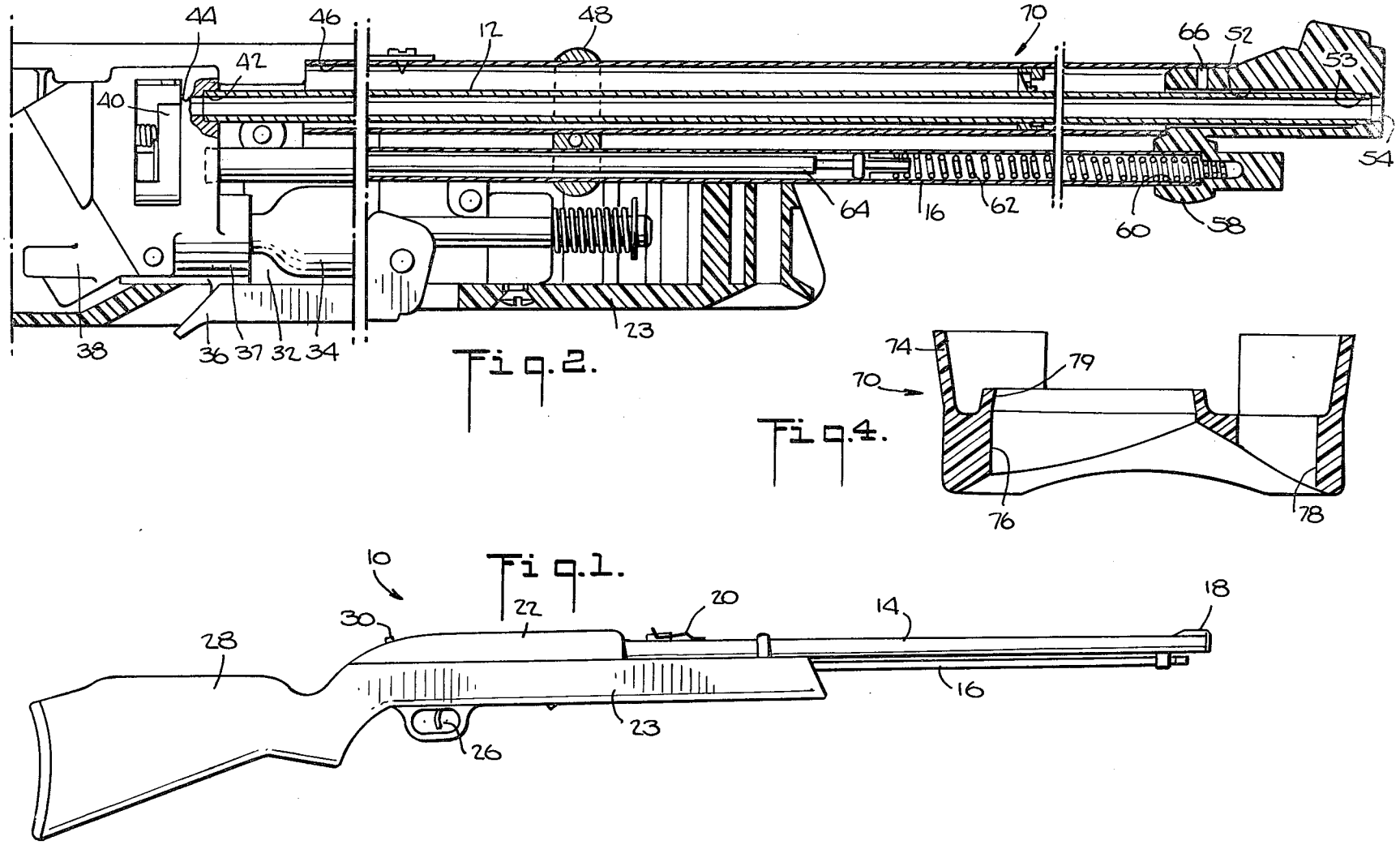
FIG. 1 is a side elevational view of a gun or gun having a support for the gun barrel constructed in accordance with the present invention.
FIG. 2 is an enlarged fragmentary longitudinal cross-sectional view of the gun with parts broken out for ease of illustration.
FIG. 4 is an enlarged cross-sectional view of the gun barrel support.
Figure 3:
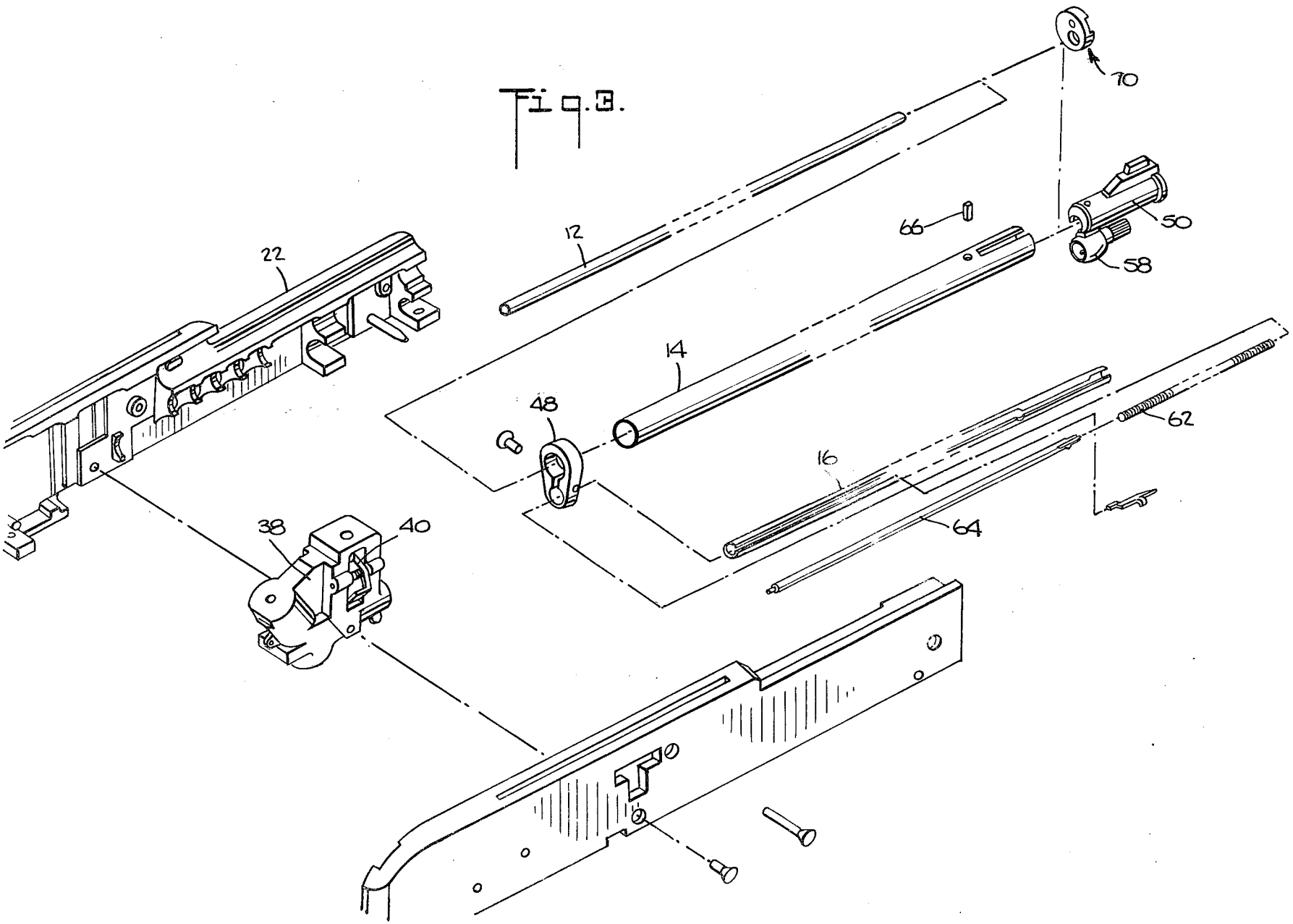
FIG. 3 is an exploded perspective view of various parts of the gun illustrated in FIG. 1 including the support for the gun barrel.

Referring now to the drawings, particularly to FIG. 1, there is illustrated a gun, for example a gas fired gun generally designated 10 for firing BB shot, including a barrel 12 (FIG. 2) within a barrel shroud 14, a magazine tube 16 underlying and supported by barrel shroud 14 for housing a plurality of BB shot, a front sight 18 and a rear sight 20 both mounted on barrel shroud 14, a receiver or frame 22, a stock 23, a trigger 26, a butt 28, and a safety lever 30. It will be appreciated, that except for the barrel support discussed in detail hereinafter and other features of the gun described and illustrated herein which are the subject of other pending patent applications of common assignee herewith, the foregoing elements as well as their arrangement and function are generally well known in this art and further description thereof is not believed necessary. For background and orientation, however, and before describing the novel and improved barrel support hereof, the various parts illustrated and their general functions will be briefly described.

The receiver 22 within stock 23 defines a chamber 32 receiving a cartridge 34 containing a gas under pressure. A lever 36 clloses chamber 32 and the end of cartridge 34 is received in a puncturing or piercing device within boss 37 carried by a valve assembly 38. Thus, when cartridge 34 is disposed in chamber 32 and lever 36 is closed, the cartridge is punctured and gas is supplied to a valve assembly 38 for discharge through barrel 12 to fire a BB shot. Valve assembly 38 also carries a loader arm 40 for transferring each individual BB shot serially aligned in magazine tube 16 into an in-line position with the rearmost end of barrel 12 and a valve passage, not shown. Loader arm 40 is actuated in response to squeezing trigger 26 by a trigger mechanism, not shown, and forming no part of the present invention. For present purposes, it is sufficient to note that the rearmost end of barrel 12 is supported in the valve assembly housing 39 in a bore 42 in alignment with a passage 44 and with the BB shot in loader arm 40. Also, from a revies of FIG. 2 it will be seen that the rearmost end portion of barrel shroud 14 is also supported in a bore 46 formed in the forward end of frame or receiver 22. As illustrated in FIG. 2, a barrel band 48 is provided about barrel shroud 14 and magazine tube 16.

At the opposite end of gun barrel 12 and barrel shroud 14, there is provided a front sight support 50 comprised of a generally annular plug having an axial bore 52, an intermediate reduced diameter bore 53, and a reduced diameter opening 54 at its forwardmost end. Bore 53 receives and seats the forward end portion or tip of gun barrel 12 in annular plug 50. Barrel shroud 14 has a slot along its upper side adjacent its forward end for receiving the front sight 18 which upstands from plug 50. Plug 50 also has a depending support 58 which is apertured to receive and support the forward end of magazine tube 16. Magazine tube 16 includes a spring 62 and a pusher rod 64 for continuously biasing BB shot contained within magazine tube 60 in a rearward direction toward loader arm 40. The lower side or end portion of shroud 14 is also slotted to receive the plug 50 and the depending support 58. A roll pin 66 secures plug 50 to barrel shroud 14.

Figures 5, 6, 7, 8:
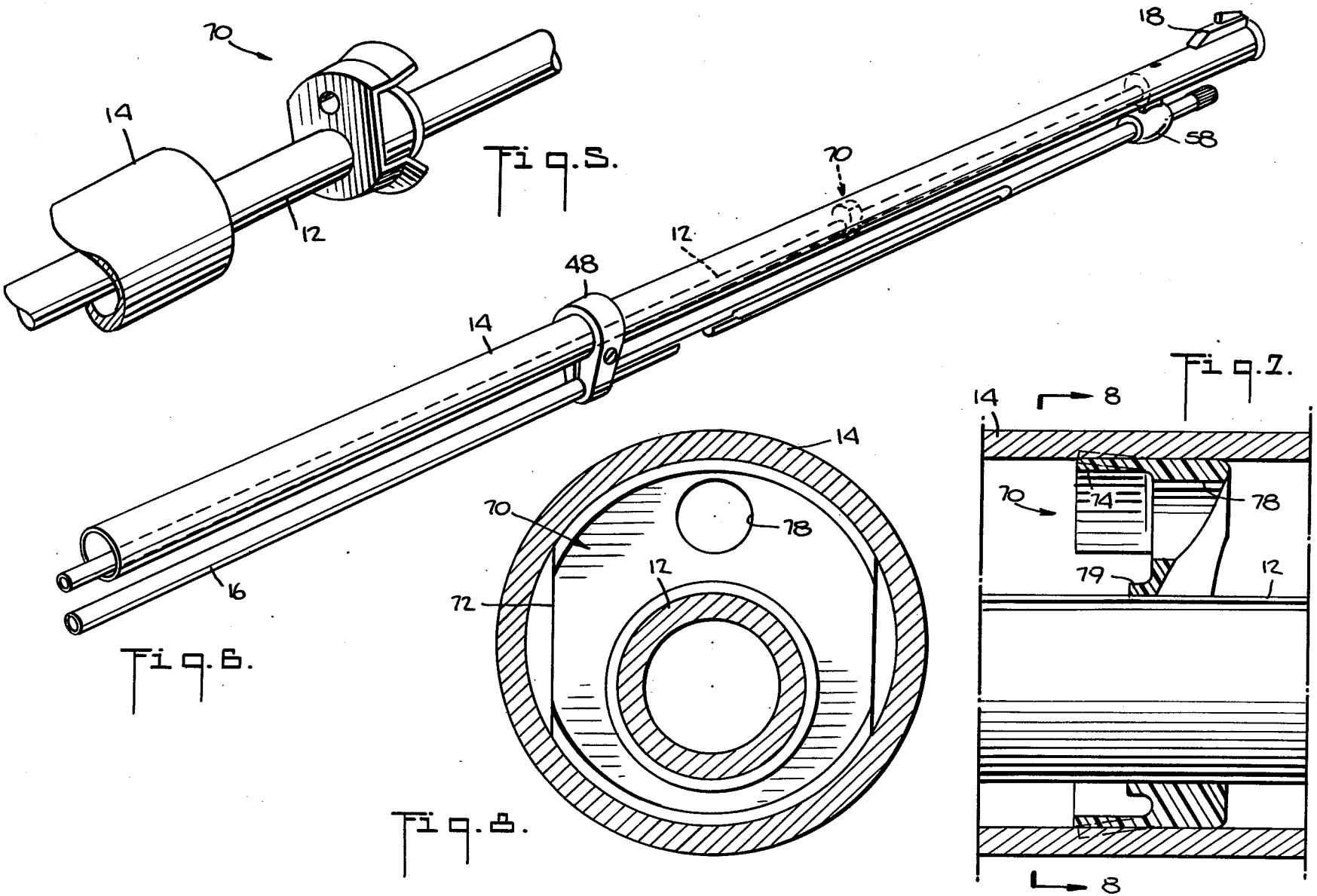
FIG. 5 is an enlarged fragmentary perspective view of the gun barrel and support.
FIG. 6 is a fragmentary perspective view of the gun barrel, shroud and magazine tube illustrating the support for the gun barrel within the barrel shroud.
FIG. 7 is an enlarged fragmentary cross-sectional view illustrating the gun barrel support within the barrel shroud and about the barrel.
FIG. 8 is a longitudinal cross-sectional view thereof taken generally about on line 8—8 in FIG. 7.

As best illustrated in FIGS. 4, 7 and 8, and in accordance with the present invention, there is provided a support for barrel 12 intermediate its end supports, i.e. the valve assembly 38 at the rearmost end of barrel 12 and the plug 50 at the forward tip of barrel 12. The intermediate support includes a support element or ring generally designated 70. Support ring 70 comprises a generally circular element having flats 72 formed along its opposite sides. The forward facing side of element 70 has a pair of diametrically opposed acurate marginal portions 74. Margins 74 extend forwardly beyond the main body of element 70 and flare slightly radially outwardly. Preferably, element 70 is formed of a plastic material and it will thus be apppreciated that the marginal portions 74 are resilient and may flex inwardly upon insertion of element 70 into shroud 14.

The main body of element 70 includes an opening 76 for receiving barrel 12 and an opening 78 for use in conjunction with a centering tool, not shown, when the support element is disposed within barrel shroud 14 in its barrel supportive position. From FIG. 4, it will be seen that the margins 79 about an in part defining opening 76 are tapered radially inwardly. As will be appreciated from a review of FIG. 4, the barrel opening 76 is off-center as is the centering opening 78. It will be noted that barrel 12 is also off-center or off the axis of shroud 14 in final assembly of the barrel with shroud 14, and particularly barrel 12 lies below the axis of shroud 14 as illustrated in FIG. 2.

When barrel 12 and element 70 are initially

When barrel 12 and element 70 are initially disposed within barrel shroud 14, margins 74 flex resiliently inwardly to the full line positions illustrated in FIG. 7. Thus, margins 74 resiliently bear against the inside surfaces of shroud 14 to maintain a friction fit between element 70 and shroud 14. Similarly, the margins 79 about the opening 76 of element 70 normally taper radially inwardly. Upon insertion of barrel 12 through opening 76 of element 70 facilitated by conical surface 80, these margins 79 flex away from but resiliently bear against the barrel to maintain a friction fit with the barrel. Thus, element 70 is maintained in a supportive position for the barrel through a friction fit with both the barrel and shroud.

The element 70 is disposed preferably about medially of the barrel 12. The element 70 is also properly centered rotationally by a centering tool, not shown. Consequently, the barrel opening 76 of element 70 and the intermediate portions of the barrel are maintained in straight-line or linear location vis-a-vis the supports for the barrel at its opposite ends. The flats 72 are included to permit the support to enter the shroud past the slots **14*a* and 14*b* in the shroud provided for the front sight 18. These slots 14*a* and 14*b* have internal blanking burrs and distortions which otherwise would damage the barrel support. The relative position of the flats 72 and the front sight slots 14*a* and 14*b* necessitate that the barrel support be rotated 90° about the shroud axis between initial insertion and final placement by the insertion tool. The slots 14*a* and 14*b*** also serve to orient the barrel support to the front sight vis-a-vis the insertion tool.

The support element is preferably formed of polycarbonate with between 0 to 40% about 5;1 % glass fiber filler. The glass fiber filler should not cause a significant loss of friction in the surface of the support element. A suitable material is available under the trade designation Lexan® 500.

If desired more than one insert may be used to achieve greater accuracy.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A gun comprising:

a gun frame;

a gun barrel shroud;

means carried by said frame for supporting an end portion of said barrel shroud;

a gun barrel within said barrel shroud and spaced radially therefrom;

means carried by said frame for supporting an end portion of said barrel;

means coupling the opposite end portion of said barrel and the opposite end portion of said barrel shroud one to the other for supporting said opposite barrel end within said shroud;

means disposed within said shroud intermediate the opposite end portions thereof for supporting the gun barrel at a location intermediate the barrel support means at the opposite ends of said barrel thereby maintaining the barrel substantially straight throughout its length, and said intermediate supporting means having a through opening for receiving the gun barrel, said intermediate supporting means having attached thereto outer margins for bearing against the inside wall surface of the shroud, said margins flaring outwardly from and extending from said intermediate supporting means in axial and radial directions.

2. A gun according to claim 1 wherein said intermediate supporting means is frictionally retained within said shroud.

3. A gun according to claim 1 wherein said outer margins are formed of a resilient material and resiliently bear against the inside wall surface of said shroud to frictionally retain said intermediate supporting means within said shroud.

4. A gun according to claim 1 wherein said intermediate supporting means has a second opening for use in orienting the barrel within said shroud.

5. A gun according to claim 1 wherein said intermediate supporting means is formed of a plastic material.

6. A gun according to claim 1 wherein said intermediate supporting means has inwardly flaring margins about said opening, said inwardly flaring margins being formed of a resilient material and resiliently bearing against the outside wall surface of said barrel to frictionally retain said element about said barrel.

7. A gun according to claim 1 wherein said barrel and the opening through said intermediate supporting means are offset from the longitudinal axis of said barrel shroud.

8. In a gun having a barrel within and spaced radially from a barrel shroud, a gun frame supporting end portions of the gun barrel and the barrel shroud and means coupling the opposite end portions of the gun barrel and barrel shroud one to the other for supporting the opposite barrel end within said shroud, apparatus for supporting said gun barrel within said shroud including an element having a through opening for receiving the gun barrel, said element having attached thereto outer margins for bearing against the inside wall surface of the shroud, said margins flaring outwardly from and extending from said element in axial and radial directions, said margins being formed of a resilient material for resiliently bearing against the inside wall surface of the shroud, means carried by said element for centering the element within the gun shroud, and means carried by said element for frictionally retaining said element about the barrel.

9. Apparatus according to claim 10 wherein said element retaining means has radially inwardly flaring margins about said opening, said margins being formed of a resilient material for resiliently bearing against the outside wall surface of the barrel to frictionally retain said element about the barrel.

10. Apparatus according to claim 9 wherein said inwardly flaring margins project axially from said element in the same axial direction as said outer margins project from said element.

11. Apparatus according to claim 8 wherein said opening through said element is offset from the center of said element.

12. Apparatus according to claim 8 wherein the opposite sides of said element are flat.

13. Apparatus according to claim 8 wherein said centering means comprises a through centering opening carried by said element adjacent the first mentioned opening.

14. Apparatus according to claim 8 wherein said element retaining means radially inwardly flaring margins about said opening, said margins being formed of a resilient material for resiliently bearing against the outside wall surface of the barrel to frictionally retain said element about the barrel, said element carrying a through centering opening adjacent the first mentioned opening.

15. A gun comprising:

a gun frame;

a gun barrel shroud;

means carried by said frame for supporting an end portion of said barrel shroud, a gun barrel within said barrel shroud and spaced radially therefrom, means carried by said frame for supporting an end portion of said barrel, means coupling the opposite end portion of said barrel and the opposite end portion of said barrel shroud one to the other for supporting said opposite barrel end within said shroud;

means disposed within said shroud intermediate the opposite end portions thereof for supporting the gun barrel at a location intermediate the barrel support means at the opposite ends of said barrel thereby maintaining the barrel substantially straight through its length, said intermediate supporting means having a through opening for receiving the gun barrel, said intermediate supporting means having attached thereto outer margins for bearing against the inside wall surface of the shroud, said margins flaring outwardly from and extending from said intermediate supporting means in axial and radial directions, and means carried by said intermediate supporting means for centering the intermediate supporting means within the gun shroud.

16. A gun comprising:
a gun frame;
a gun barrel shroud;
means carried by said frame for supporting an end portion of said barrel shroud,
a gun barrel within said barrel shroud and spaced radially therefrom;
means carried by said frame for suopporting an end portion of said barrel,
means coupling the opposite end portion of said barrel and the opposite end portion of said barrel shroud one to the other for supporting said opposite barrel end within said shroud;
means disposed within said shroud intermediate the opposite end portions thereof for supporting the gun barrel at a location intermediate the barrel support means at the opposite ends of said barrel thereby maintaining the barrel substantially straight throughout its length, and said intermediate supporting means having a through opening for receiving the gun barrel, said intermediate supporting means having attached thereto outer margins for bearing against the inside wall surface of the shroud, said margins flaring outwardly from and extending from said element in axial and radial directions, said margins being formed of a resilient material for resiliently bearing against the inside wall surface of the shroud, and means carried by said intermediate supporting means for centering the intermediate supporting means within the gun shroud.

* * * * *